US010208441B2

(12) United States Patent
van Eijl et al.

(10) Patent No.: US 10,208,441 B2
(45) Date of Patent: Feb. 19, 2019

(54) PULL BEHIND ICE RESURFACING MACHINE AND METHOD OF USE

(71) Applicants: Paul van Eijl, Fountain City, WI (US); Dave van Eijl, Elgin, MN (US); Kevin Christ, Minnetrista, MN (US)

(72) Inventors: Paul van Eijl, Fountain City, WI (US); Dave van Eijl, Elgin, MN (US); Kevin Christ, Minnetrista, MN (US)

( * ) Notice: Subject to any disclaimer, the term of this patent is extended or adjusted under 35 U.S.C. 154(b) by 78 days.

(21) Appl. No.: 15/529,763

(22) PCT Filed: Nov. 25, 2015

(86) PCT No.: PCT/US2015/062600
§ 371 (c)(1),
(2) Date: May 25, 2017

(87) PCT Pub. No.: WO2016/086094
PCT Pub. Date: Jun. 2, 2016

(65) Prior Publication Data

US 2017/0306578 A1 Oct. 26, 2017

Related U.S. Application Data

(60) Provisional application No. 62/085,186, filed on Nov. 26, 2014.

(51) Int. Cl.
*E01H 4/02* (2006.01)

(52) U.S. Cl.
CPC ..... *E01H 4/023* (2013.01)

(58) Field of Classification Search
CPC .. E01H 4/023; E01H 4/02; E01H 4/00; E01H 5/00; E01H 5/06; E01H 5/08; E01H 5/12
USPC ..... 299/24
See application file for complete search history.

(56) References Cited

U.S. PATENT DOCUMENTS

| | | | | | |
|---|---|---|---|---|---|
| 92,542 | A * | 7/1869 | Pough | E01H 4/023 | 299/24 |
| 136,854 | A | 3/1873 | Mullaly | | |
| 2,642,679 | A * | 6/1953 | Zamboni | E01H 4/023 | 37/219 |
| 2,763,939 | A * | 9/1956 | Zamboni | E01H 4/023 | 299/24 |
| 2,795,870 | A * | 6/1957 | Leduc | E01H 4/023 | 172/123 |
| 3,178,837 | A * | 4/1965 | Capalbo | E01H 4/023 | 200/38 FB |
| 3,302,975 | A | 2/1967 | Vandenberg | | |
| 3,475,056 | A * | 10/1969 | Jones | E01H 4/023 | 299/24 |

(Continued)

FOREIGN PATENT DOCUMENTS

| | | | | |
|---|---|---|---|---|
| CA | 2174998 A1 * | 10/1997 | E01H 1/045 | |
| CA | 2522539 A1 * | 10/2004 | E01H 4/023 | |

(Continued)

*Primary Examiner* — Robert E Pezzuto
*Assistant Examiner* — Joan D Misa
(74) *Attorney, Agent, or Firm* — Greg N. Geiser; Gutwein Law

(57) ABSTRACT

A pull-behind device to resurface an ice rink. The device includes a rotating brush to sweep the ice anterior to a blade used to the scrape the ice. Collected snow is moved into a water reservoir where it is stored and melted for redeposit onto the skating surface.

10 Claims, 3 Drawing Sheets

(56) References Cited

U.S. PATENT DOCUMENTS

| | | | | | |
|---|---|---|---|---|---|
| 3,591,236 | A * | 7/1971 | Jones | E01H 4/023 | 180/6.48 |
| 3,622,205 | A * | 11/1971 | Zamboni | E01H 4/023 | 172/500 |
| 3,917,350 | A * | 11/1975 | Bricher | E01H 4/023 | 299/24 |
| 4,312,142 | A * | 1/1982 | Toepffer | E01H 4/023 | 239/208 |
| 4,317,298 | A * | 3/1982 | Mathers | E01H 4/023 | 37/219 |
| 5,561,921 | A * | 10/1996 | Vanderlinden | E01H 1/001 | 15/78 |
| 6,138,387 | A * | 10/2000 | Fox | A63C 19/10 | 37/196 |
| 7,380,355 | B2 * | 6/2008 | Donaldson | E01H 4/023 | 37/219 |
| 7,510,247 | B2 * | 3/2009 | Pirila | E01C 19/006 | 299/1.5 |
| 8,671,596 | B2 * | 3/2014 | Manion | E01H 4/023 | 299/24 |
| 9,353,494 | B2 * | 5/2016 | Arntz | E01H 5/045 | |
| 2006/0097564 | A1 | 5/2006 | Seely | | |
| 2009/0188135 | A1 * | 7/2009 | Manion | E01H 4/023 | 37/219 |
| 2014/0237862 | A1 | 8/2014 | van Eiji | | |

FOREIGN PATENT DOCUMENTS

| | | | | |
|---|---|---|---|---|
| CA | 2694948 | A1 * | 8/2011 | B60R 11/00 |
| FR | 2729683 | A1 * | 7/1996 | E01H 4/023 |
| WO | WO-2017197089 | A1 * | 11/2017 | E01H 4/00 |

* cited by examiner

PULL BEHIND ICE RESURFACING MACHINE AND METHOD OF USE

CROSS REFERENCE TO RELATED APPLICATIONS

This application claims priority to U.S. Provisional Patent Application No. 62/085,186 filed 26 Nov. 2014 to the above named inventors, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a pull-behind device to resurface an ice rink.

BACKGROUND

A traditional ice-resurfacing machine is a specially designed vehicle for operation on an ice surface. This machine is typically is constructed on a vehicle chassis and includes a watering and scraping unit and storage compartments for both water and scrapped ice. A standard ice resurfacing vehicle is quite large, often the size of a large automobile, making it expensive to purchase and operate.

Although a standard ice-resurfacing machine is effective at resurfacing the ice, it may not be suitable or cost effective in all situations. In some instances a simpler and easier ice resurfacing system is desired. This system must be cost effective, easy to operate, and preferably utilize a users existing equipment.

SUMMARY OF THE INVENTION

A pull-behind ice-resurfacing device for resurfacing an ice rink is disclosed. The device is designed to be pulled behind an existing utility vehicle such as an all terrain vehicle (ATV), utility vehicle, golf cart, or similar vehicle utilizing a trailer-style hitch. The device primarily includes a frame defining a perimeter of the device and allowing for the attachment of the device wheels and internal components. The major components include, but are limited to, a hitch arm, wheels, a brush or paddle, a blade, a water storage chamber, heaters, and a mat.

In use, the device is pulled onto the area to be resurfaced where it is engaged with the surface and pulled along by the utility vehicle. This movement will in turn operate the brush, scrape the ice, move the shavings to the storage chamber, and deposit water onto the ice surface.

BRIEF DESCRIPTION OF THE DRAWINGS

The accompanying drawings arc included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
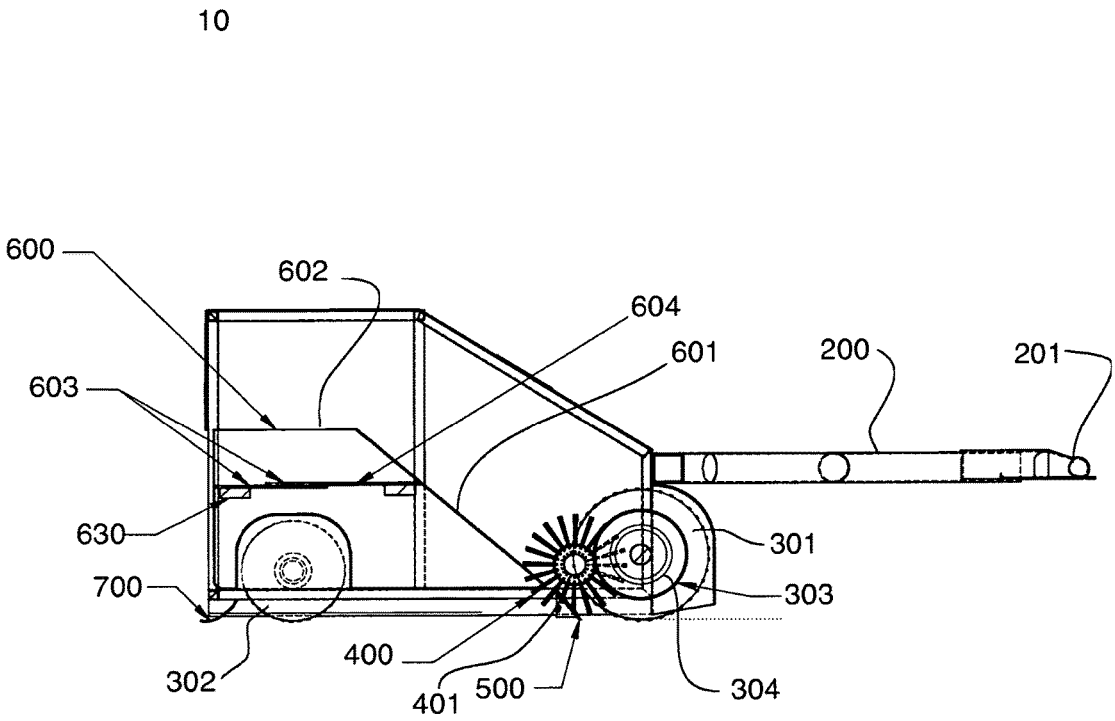
FIG. 1 is an side view of the device, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms arc meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
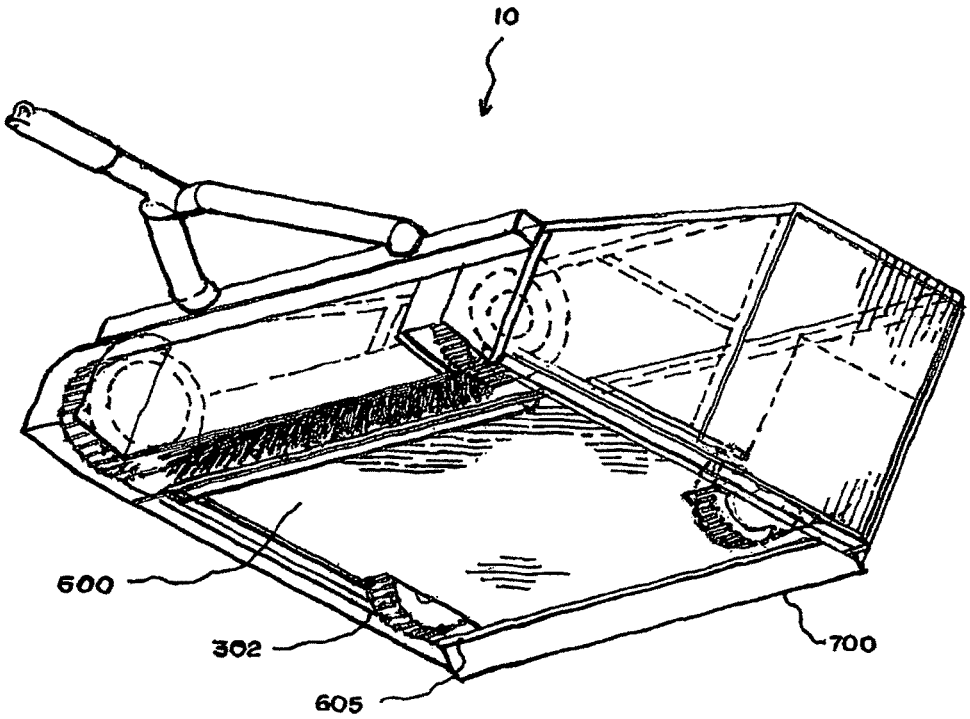
FIG. 2 is an isometric bottom view of the device, according to the present invention.
Figure 3:
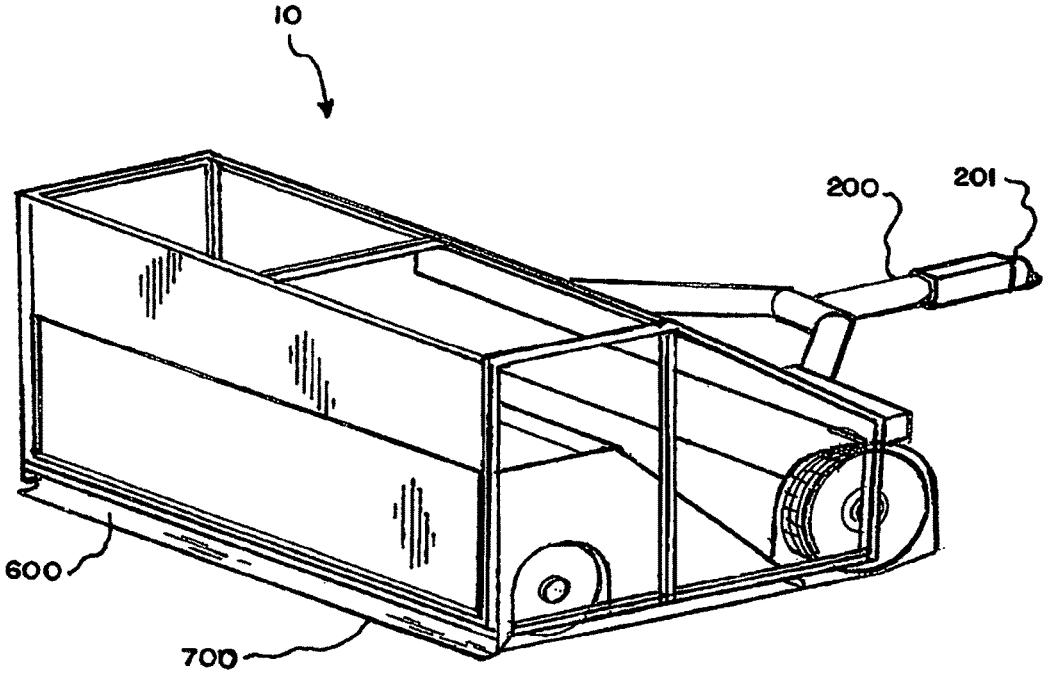
FIG. 3 is an isometric side view of the of the device, according to the present invention.

Referring now to FIG. 1-3, various views of a pull-behind ice-resurfacing device, generally referred to as 10, are shown. In the preferred embodiment of the present invention, the device 10 is comprised of frame defining a perimeter of the device 10 and defining the device 10 width and length. This frame is preferably rigid and designed to easily support the internal components of the device and provide strength and support. At a first end of the device 10 a hitch arm 200 extends outward culminating in a hitch 201. The hitch 201 is universal in nature and allows the device 10 to be attached to any type of vehicle having a corresponding hitch 201 receiver. This hitch arm 200 and hitch 201 offer attachment to the vehicle to allow the device 10 to be pulled along the ice surface.

At this first end of the device 10 and adjacent to the hitch arm 201 a first pair of wheels 301 are placed. A second pair of wheels 302 are placed at a second end of the device 10 and opposite the first pair of wheels 301. These two pair of wheels 301, 302 allow the device 10 to be easily moved onto the surface and pulled along. A brush/paddle 400 is located behind the first pair of wheels 301 and in mechanical communication with the wheels 301, wherein movement of the wheels 301 provides rotational movement of the brush/paddle 400. The brush/paddle 400 may be a common bristle-style brush as is found within the prior art or alternatively the brush/paddle 400 may be comprised of a stiff rubber or rubber-like member resembling a paddle, and wherein the brush/paddle 400 may be selected or changed dependent upon the conditions of a given surface.

In the preferred embodiment of the present invention, the first pair of wheels 301 includes a gear 303 at its hub to receive a mechanical linkage 304 in communication with a corresponding gear 401 located on an axle of the brush/paddle 400. This mechanical linkage 304 may be a belt, chain, or other similar linking member. It is preferred, that these corresponding gears 303, 401 are set at a ratio to allow for rapid rotation of the brush/paddle 400 with slight rotation of the wheels, wherein one revolution of the wheels 301 will result in several rotations of the brush/paddle 400.

The brush/paddle 400 is cylindrical and rotates in clockwise direction along a width of the device 10. The brush/paddle 400 extends the width of the device 10 and includes a plurality of stiff bristles or paddles to contact the ice surface and sweep snow and shaved ice off of the ice surface and move it towards the rear of the device 10. Immediately behind the brush/paddle 400, is the blade 500. The blade 500 is in physical communication with the brush/paddle 400 and extends the width of the device 10. The blade 500 is designed to be mounted in an angular fashion in frictional communication with the ice surface to shave and scrape worn ice. The blade 500 is movable to various positions to allow for transport of the device 10 off of the ice surface and to vary the scraping depth of the ice surface.

Immediately behind and above the blade 500 is a leading edge of the storage reservoir 600. The storage reservoir is wedge shaped and extends a width of the device 10 with the leading edge forming an incline 601 to an open top portion 602 of the reservoir 600. The incline 601 is adjacent the leading edge of the blade 500 and aligned with the brush 400, wherein the wedge shape acts as a modified incline plane to move snow off of the ice surface and into the open top 602 of the storage reservoir 600.

The storage reservoir 600 is designed to hold fresh water for placement onto the ice surface and additionally hold swept ice shavings and snow. The reservoir 600 includes a perforated ceiling panel 603 that floats on water within the reservoir 600 through flotation members 630 and acts as a filtration membrane for shaved snow and ice. Additionally, the reservoir 600 may include a water heater 604. The water heater 604 allows the user to heat the reservoir 600 to melt any residual snow and shaved ice during storage of the device 10.

The reservoir 600 will include at its lower surface a watering unit 605. The watering unit 605 will evenly distribute water onto the ice at the rear of the device 10. The flow of water placed onto the ice is controlled and further distributed with a trailing mat 700. Preferably, the watering unit 605 contains a plurality of apertures extending the width of the device 10 and utilizes gravity to control the flow of water from the watering unit and reservoir 600 onto the ice surface.

In use, a user will fill the reservoir 600 with water and transport the device 10 to the ice surface utilizing the hitch 201 in communication with a vehicle. Once on the ice surface, the user will engage the blade 500, start the watering unit, and pull the device 10 around the ice surface. As the device 10 is pulled around the ice surface, the wheels 301 will turn the brush/paddle 400 to remove shavings and snow from the ice surface and deposit the snow into the reservoir unit 600. At the conclusion of the ice resurfacing, the device 10 water heater 604 within the reservoir may be used to heat and melt any collected snow for re-use and redeposit onto the ice surface. This ability to re-use collected shavings will result in water savings and costs savings associated with the operation of the device 10.

In the preferred embodiment of the present invention, the device 10 is easily transported to an ice surface and provides a quick and inexpensive solution to the resurfacing of an ice rink. The device 10 reservoir 600 has a capacity of 110 gallons of water and width of approximately 6 feet. Preferably, this reservoir 600 is removable via a sliding mechanism to allow a user to easily dump out the contents of the collected snow and ice shavings, should the user not want to re-use the collected shavings. It is preferred that the device 10, utilize mechanical mechanisms to resurface and condition the ice with minimal powered components for ease of use and maintenance.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. An ice-resurfacing device, the ice-resurfacing device pulled behind a vehicle around an ice surface, the ice resurfacing device comprising:

a frame, the frame defining a perimeter of the device and providing a structure for the placement of the various parts of the device, the frame defining a front of the device and a rear of the device, the front of the device orientated in a direction of travel of the device, the rear of the device opposite the front of the device, the distance between the front of the device and the rear of the device defining a length of the device, the frame further defining sides of the device, the sides in communication with the front of the device and the rear of the device, the distance between the sides of the device defining a width of the device;

a hitch, the hitch extending from the front of the device opposite the rear of the device, the hitch having an end, the end configured for attachment to the vehicle;

a first pair of wheels, the first pair of wheels disposed substantially within the frame and contacting the ice-surface, wherein the first pair of wheels aids in mobility of the device;

a second pair of wheels, the second pair of wheels disposed substantially within the frame and contacting the ice-surface, wherein the second pair of wheels aids in mobility of the device;

a rotating brush, the rotating brush extending the width of the device and contacting the ice-surface, the brush in communication with at least one of said pairs of wheels, wherein movement of the wheels causes rotational movement of the brush;

a water reservoir, the water reservoir disposed within the frame and forming a cavity for the placement of water, the reservoir having an open top portion, the water reservoir having a sloped leading edge, the sloped leading edge sloped from the lower front of the device towards the upper rear of the device at the open top, the sloped leading edge positioned behind the rotating brush, wherein brushed materials are disposed on the sloped leading edge and moved to the open top, the water reservoir having a lower watering unit, the lower water unit adapted to place water onto the ice surface; and a blade, the blade extending the width of the frame and located adjacent to the brush opposite the front of the device, the blade positioned on the lower portion of the watering unit at the leading edge of the sloped leading edge, the blade adapted to contact the ice surface.

2. An ice resurfacing device as in claim 1, wherein the rotating brush is a rubber paddle.

3. An ice resurfacing device as in claim 1, wherein the water reservoir includes a floating ceiling panel, the floating ceiling panel sized for receipt within the water reservoir and perforated to allow for the flow of water, the perforated floating ceiling panel operating as a filtration member.

4. An ice resurfacing device as in claim 1, wherein the device includes a heater, the heater adapted to heat the contents of the water reservoir.

5. An ice resurfacing device as in claim 1, wherein the water reservoir is slidably received within a rear of the device.

6. An ice resurfacing device as in claim 1, wherein the blade height is adjustable.

7. An ice-resurfacing device, the ice-resurfacing device pulled behind a vehicle around an ice surface, the ice resurfacing device comprising:

a frame, the frame defining a perimeter of the device and providing a structure for the placement of the various parts of the device, the frame defining a front of the device and a rear of the device, the front of the device orientated in a direction of travel of the device, the rear of the device opposite the front of the device, the distance between the front of the device and the rear of the device defining a length of the device, the frame further defining sides of the device, the sides in communication with the front of the device and the rear of the device, the distance between the sides of the device defining a width of the device;

a hitch, the hitch extending from the front of the device opposite the rear of the device, the hitch having an end, the end configured for attachment to the vehicle;

a first pair of wheels, the first pair of wheels disposed substantially within the frame and contacting the ice-surface, wherein the first pair of wheels aids in mobility of the device;

a second pair of wheels, the second pair of wheels disposed substantially within the frame and contacting the ice-surface, wherein the second pair of wheels aids in mobility of the device;

a rotating brush, the rotating brush extending the width of the device and contacting the ice-surface, the brush in communication with at least one of said pairs of wheels, wherein movement of the wheels causes rotational movement of the brush;

a water reservoir, the water reservoir disposed within the frame and forming a cavity for the placement of water, the water reservoir having an open top portion, the water reservoir having a sloped leading edge, the sloped leading edge sloped from the lower front of the device towards the upper rear of the device at the open top, the sloped leading edge positioned behind the rotating brush, wherein brushed materials are disposed on the sloped leading edge and moved to the open top, the water reservoir having a lower watering unit, the lower water unit adapted to place water onto the ice surface, the water reservoir in communication with the second pair of wheels and adapted for slidable receipt within the frame, wherein the water reservoir is separable from the frame for emptying and filling;

a blade, the blade movable from an engaged position to a transport position, the blade extending the width of the frame and located adjacent to the brush opposite the front of the device, the blade positioned on the lower portion of the watering unit at the leading edge of the sloped leading edge, the blade adapted to contact the ice surface; and a floating ceiling panel, the floating ceiling panel sized for receipt within the water reservoir and perforated to allow for the flow of water, the perforated floating ceiling panel operating as a filtration member.

8. An ice resurfacing device as in claim 7, wherein the rotating brush is a paddle.

9. An ice resurfacing device as in claim 7, wherein the device includes a heater, the heater adapted to heat the contents of the water reservoir.

10. An ice resurfacing device as in claim 9, wherein the device includes a trailing mat, the trailing mat positioned below the water reservoir, wherein the trailing mat disperses expelled water.

* * * * *